US010030400B2

(12) United States Patent
Claffey

(10) Patent No.: US 10,030,400 B2
(45) Date of Patent: Jul. 24, 2018

(54) FORMATION AIDS FOR USE IN FORMING SWIMMING POOLS AND ASSOCIATED METHOD

(71) Applicant: Brian Claffey, Colleyville, TX (US)

(72) Inventor: Brian Claffey, Colleyville, TX (US)

( * ) Notice: Subject to any disclaimer, the term of this patent is extended or adjusted under 35 U.S.C. 154(b) by 405 days.

(21) Appl. No.: 14/563,654

(22) Filed: Dec. 8, 2014

(65) Prior Publication Data

US 2015/0159391 A1 Jun. 11, 2015

Related U.S. Application Data

(62) Division of application No. 12/717,720, filed on Mar. 4, 2010, now Pat. No. 8,904,576.

(51) Int. Cl.

| | |
|---|---|
| ***E04H 4/00*** | (2006.01) |
| ***E04H 4/12*** | (2006.01) |
| ***E04H 4/14*** | (2006.01) |

(52) U.S. Cl.

CPC ..... *E04H 4/0081* (2013.01); *E04H 4/00* (2013.01); *E04H 4/12* (2013.01); *E04H 4/14* (2013.01)

(58) Field of Classification Search

CPC ..... E04H 4/00; E04H 4/0075; E04H 4/0081
USPC ..... 4/506, 507, 488
See application file for complete search history.

(56) References Cited

U.S. PATENT DOCUMENTS

| | | | | |
|---|---|---|---|---|
| 3,705,469 | A * | 12/1972 | Eriksson | B28B 23/005 249/66.1 |
| 3,831,897 | A * | 8/1974 | Stegmeier | E04H 4/1272 249/1 |
| 5,978,978 | A * | 11/1999 | Claffey | E04H 4/1227 4/506 |
| 8,904,576 | B2 * | 12/2014 | Claffey | E04H 4/00 4/506 |

* cited by examiner

*Primary Examiner* — Huyen Le
(74) *Attorney, Agent, or Firm* — Braxton Perrone, PLLC

(57) ABSTRACT

A formation aid, for use in the forming of receptacles in a swimming pool, includes a three-dimensional body having an essentially conical shape. The three-dimensional body of the formation aid includes a narrow end, for placement near an interior edge of the swimming pool during formation of the swimming pool; and a wide end, for placement remote from the interior edge of the swimming pool, in order to form a receptacle.

6 Claims, 7 Drawing Sheets

FORMATION AIDS FOR USE IN FORMING SWIMMING POOLS AND ASSOCIATED METHOD

This application claims priority to co-pending U.S. patent application Ser. No. 12/717,720 filed Mar. 4, 2010, which is hereby incorporated by reference.

TECHNICAL FIELD

The present application relates to the field of swimming pool construction, and more particularly to apparatus for facilitating swimming pool water circulation system installation and preventing introduction of debris into areas that may compromise the pool construction process.

BACKGROUND

Prior to World War II, the vast majority of swimming pools were public pools or private group owned facilities. Since that time, and mostly in the past thirty years, residential swimming pools have become increasingly popular so that the number of swimming pools in the United States has grown dramatically. Swimming pools were formerly made with forms and poured concrete but formless construction, wherein the concrete is sprayed in place over a pre-assembled matrix of reinforcing bar, has reduced both the cost and construction time. Where once, virtually every pool had required a custom made circulation and filtration system, packaged units became available in a range of sizes, so as to allow additional savings. These economies, together with price competition among the installers, served to accelerate growth of the swimming pool industry. Inasmuch as the need for routine maintenance tends to discourage prospective pool buyers, maturation of the industry has been marked by the advent of labor saving devices such as automatic surface skimmers and self-operating pool vacuums.

Maturation of the industry is accompanied by more intense competition among the pool installers. In a typical scenario, a pool installation company will subcontract the specialized construction phases, excavation, re-bar placing and tying, concrete spraying, tile work, plastering and decking to subcontractors. Construction methods are virtually standardized in the industry and often, the same sub-contractors will work for several pool installation companies. As a result, the cost basis for similar products of similar quality is much the same to all installers and each of them is driven to control internal operating costs and shave profit margins in order to remain competitive. Sub-contractor supervision and quality control are the factors that management can control. Since sub-contractor supervision is purely a management skill, to which all have equal access, the labor of plumbing and pool equipment installation and the efficacy of quality control are the only areas where a competitive advantage may be achieved. Therefore, there is a continuing need for refining and improving these operations.

In recent years, homeowners, municipalities and commercial entities that opt to install a swimming pool have a wide array of features available for selection. These features range from complex water features such as fountains and spas in which the water circulation system includes structures that allow water to cascade down rocks or other materials. An owner may also opt for various lighting features that enhance the owner's swimming and leisure experience in the evening. Today, a pool owner is limited only by the imagination in terms of the water and lighting features that may be installed.

Regardless of whether a customer desires the ultimate backyard oasis or a more traditional lap pool, numerous receptacles necessary to carry water from and return water to the pool for filtration and circulation is necessary. These receptacles, such as the pool's drains and water return heads are common. Drains are found at the bottom of the pool structure and water return heads may be found on the bottom of the pool or on side walls. To facilitate effective water circulation, many return receptacles are situated throughout the pool.

As part of the construction process, the plumbing for carrying water away from and to the pool is installed. This takes place after excavation, but before re-bar placing and tying and concrete spraying. Once the plumbing, typically in the form of PVC is in place, re-bar is placed and tied and concrete or gunite is sprayed. After the concrete is sprayed to form the walls and floor of the pool, concrete near and around the drains and return receptacles must then be removed to permit the plumber access to later install the necessary fittings on the pipes for final installation of the drains and returns. Once removal is accomplished and the fittings are placed, the voided area is filled in again any particular type of water proofing membrane around the fittings to prevent the fittings from leaking. To accomplish the removal process, installers roughly carve out with a trowel or other tool an area that provides this access. The problems associated with this approach to providing access are many. First, the installer charged with removing the concrete does so at his own discretion in terms of the width and depth of the void left in the concrete. This presents a problem as every such carve out for the drains and return receptacles compromises the strength and water-retaining capabilities of the swimming pool. The lack of a predictable carve out can also increase the risk factor of allowing oxidation to occur within the steel structure. If any steel is exposed for a prolonged period of time, oxidation may occur. If this were the happen, the only solution is to saw cut and remove any and all oxidized steel, leading to an unsightly patch that undoubtedly result in an irate customer. In addition, when the carved out area is excessively large, gravity works against adequately refilling the space as the water proof membrane in the upper half of the void will tend to slide down and out of the opening. Moreover, any gaps left below the PVC pipe and the outer surface of the cavity may not be refilled properly. This is because the pipe itself prevents the effective blowing in of the final interior finish. Ultimately, the carve out and replacement process is a necessary evil that is time consuming, subject to many imperfections and if not done properly may require the installer to repeat the entire process. Thus, there is a need for a product that promotes the predictable and reliable carving out of the concrete in areas that will receive plumbing fittings.

Another issue associated with pool installation is the phenomenon of ground water accumulating around and beneath the swimming pool structure. If a sufficient amount of water accumulates beneath the pool, the pool structure could be displaced or float above the ground surface. Such a displacement, even if only minimal, will require installation of the pool structure to start anew. In order to prevent displacement, it is the custom within the industry to install weep holes in the floor of the pool. These weep holes are essentially spaces in the bottom of the pool in which no concrete is placed during the construction process. These spaces or voids may be one foot or less in diameter and provide an opening through the bottom of the pool to the ground. If during the construction process underground water forms or seeps to the area in close proximity to the pool, the water will enter the pool through the weep holes, rather than cause the pool to be displaced or float. Essentially, these weep holes serve as a pressure relief mechanism that prevent water build up beneath the pool.

Once construction of the pool is largely complete, the weep holes are filled with a water proofing membrane and ultimately coated as is the entire inside of the pool with marcite or similar pool interior surface product. At this juncture, the weep hole is now plugged. Although the pool construction site is stabilized, the possibility still exists for the onset of underground water build up, either through the emergence of a spring, a water main break or other source of flooding. If such a circumstance arises post-construction, the weep hole plugs will pop, permitting entry into the pool of the underground water, rather than structurally damaging displacement or float of the entire pool.

Much like the aforementioned carving out of concrete around PVC pipes to allow installation of plumbing fittings, the manner in which the weep holes are prepared and maintained during the installation process varies. Some manufacturers simply leave a round void at the bottom of the pool to serve as a weep hole. The problems with this practice are two-fold. First, a weep hole left uncovered during the installation process typically becomes filled with debris. In the haste to complete the construction process, the debris remains in the hole and is simply covered up with concrete or a water proofing membrane. As a result, a plug that should be eight inches in thickness may be only a few inches in thickness because of the volume in the hole displaced by the debris. Accordingly, the thickness of the pool at the weep holes is less than necessary to achieve adequate strength. Moreover, the thinner plug will "pop" under less pressure from even minimal underground water that would not otherwise impact the integrity of the pool walls.

Another common practice is to install a corrugated pipe within the weep hole that runs some distance underground. The ridges of the weep hole serve to grip the concrete later poured to fill the weep hole. The result is a stronger bond of the concrete within the weep hole, leaving the weep hole plug less likely to pop under minimal underground pressure. Even with the use of a corrugated pipe, however, the cylindrical shape of the plug is susceptible to premature popping and collection of construction debris. Thus, there is a need for a product that prevents debris collection and facilitates creation of a plug that is not susceptible to popping under minimal pressure.

Another issue commonly faced is once again steel oxidizing within the weep hole resulting in the weep hole to pop. In this event the pool must be completely drained down and the weep hole along with all oxidized steel to be removed. Once removing the weep hole it must be repacked with concrete or some sort of water proofing membrane. Due to the size and location of a weep hole at the bottom of the pool this patch is virtually impossible to cover up without resurfacing the entire pool.

Another commonly faced problem throughout the construction process is the protection of the light fixtures themselves prior to the completion of the pool. The installation of all electrical components are normally installed in the beginning stages of construction leaving the new light fixtures exposed to masonry cements sticking or adhering to the fixtures. In the event this happens countless energy and time is wasted on cleaning and detailing the lights prior to filling up the pool. Many practice the use of using acids to help dissolve the cements, but this stripping also destroys the light ring finish itself resulting in dull light ring finish. Protecting the entire light assembly throughout construction will avoid time and energy on the cleaning and detailing of the light prior to filling up the pool.

During swimming pool construction and water circulation system testing, the skimmer, pool drain and other plumbing receptacles are open and difficult to protect from the entry of dirt, concrete and other debris. The conventional practice of stuffing these receptacles with an empty sack does not resolve the debris problem. As a final step after construction and testing, the receptacles must be laboriously cleaned out by hand. Particularly at this time, there is a real risk of gravel, mortar, concrete or stones falling into the plumbing. Swimming pool pumps have a limited tolerance for ingesting such solids, and impeller damage or worse might result. An unfortunately sized rock might block a line at the first elbow it couldn't pass for an even worse and more expensive scenario. U.S. Pat. No. 5,978,978, assigned to Brian Claffey discloses a Method and Apparatus for Swimming Pool Construction.

SUMMARY OF THE EMBODIMENTS

One embodiment of a system for forming a swimming pool includes a plurality of rebar supports, the rebar supports forming a support structure; a water circulation system, for circulating water in the swimming pool; a formation aid, for forming a receptacle in the swimming pool, the receptacle housing a portion of the water circulation system, wherein the formation aid is a three-dimensional shape; and a construction material, that forms a solid barrier after application to the plurality of rebar supports, the construction material and the plurality of rebar supports forming the swimming pool. Optionally, the formation aid is made of cardboard. Optionally, the formation aid is covered in wax. In one alternative, the formation aid is covered in an anti-stick substance. In another alternative, the formation aid is shaped to form a weep hole. In one alternative, the formation aid has a narrow end and a wide end, and wherein the narrow end is positioned towards the interior of the swimming pool, such that the construction material forms a weep hole having a narrow end towards the interior of the pool. In another alternative, the formation aid has a horizontal angular cross-section. Alternatively, the formation aid has an essentially conical shape having a narrow end and a wide end, the essentially conical shape having an octagonal cross-section, and wherein the narrow end is positioned towards the interior of the swimming pool, such that the construction material forms an inlet hole having a narrow end towards the interior of the swimming pool. Alternatively, the formation aid has an essentially trapezoidal shape having a narrow end and a wide end, the essentially conical shape having a square cross-section, and wherein the narrow end is positioned towards the interior of the swimming pool, such that the construction material forms a weep hole having a narrow end towards the interior of the swimming pool. In one alternative, the formation aid is shaped to form the skimmer hole.

In one embodiment, a method of forming a receptacle housing a portion of a water circulation system in a swimming pool includes placing a formation aid in a position to form a weep hole; applying a construction material around the formation aid, such that the construction material surrounds the formation aid; removing the formation aid; and applying a second construction material to fill the weep hole. Alternatively, the formation aid has a narrow end and a wide end, and wherein the narrow end is positioned towards the interior of the swimming pool, such that the construction material forms a weep hole having a narrow end towards the interior of the swimming pool. In another alternative, the applying of the second construction material fills the wide end of the weep hole produced by the forming aid, such that the second construction material resists being pushed through the narrow end of the weep hole. In one alternative, the method further includes leaving the formation aid in place until the construction of the pool is substantially complete; and preventing debris from entering the weep hole with the formation aid.

In one embodiment, a formation aid, for use in the forming of receptacles in a swimming pool, includes a three-dimensional body having an essentially conical shape. The three-dimensional body of the formation aid includes a narrow end, for placement near an interior edge of the swimming pool during formation of the swimming pool; and a wide end, for placement remote from the interior edge of the swimming pool, in order to form a receptacle. In one alternative, the formation aid is removable without disturbing the structure of the swimming pool. Optionally, the formation aid is composed of cardboard. Optionally, the formation aid is coated with wax. In one alternative, the receptacle is a weep hole. In another alternative, the formation aid allows for the passage of liquids.

In addition to the cylindrical plug disclosed therein, additional protection of the opening within the pool through which water enters the skimmer. This protection, like the protection discussed above, promotes predictable application of concrete to form the pool walls and prevents adherence of unwanted concrete to the opening of the skimmer and within the skimmer opening near plumbing for water circulation. Thus, there is a need for a product that protects during construction the opening that allows water to pass from the pool to the skimmer.

In addition to the cylindrical plug disclosed herein, additional protection of the opening within the pool through which water enters the skimmer. This protection, like the protection discussed above, promotes predictable application of concrete to form the pool walls and prevents adherence of unwanted concrete to the opening of the skimmer and within the skimmer opening near plumbing for water circulation. Thus, there is a need for a product that protects during construction the opening that allows water to pass from the pool to the skimmer.

DETAILED DESCRIPTION OF THE DRAWINGS

During the formation of a swimming pool holes are created in the swimming pool structure as various receptacles for swimming pool plumbing/circulation equipment as well as lighting or other pool features. Previously, as explained in the background, receptacles were formed by not applying concrete or other formation material to the area of the receptacle or by chipping away the formation material from the receptacle area. The use of the various embodiments of a formation aid, as well as systems and methods utilizing a formation aid enhance the pool building process by allowing for more regular (in terms of shape) and structural sound receptacles, by obviating the need to remove portions of the formed swimming pool, and prevent debris from entering receptacles.

1. Formation Aid

Figure 1:
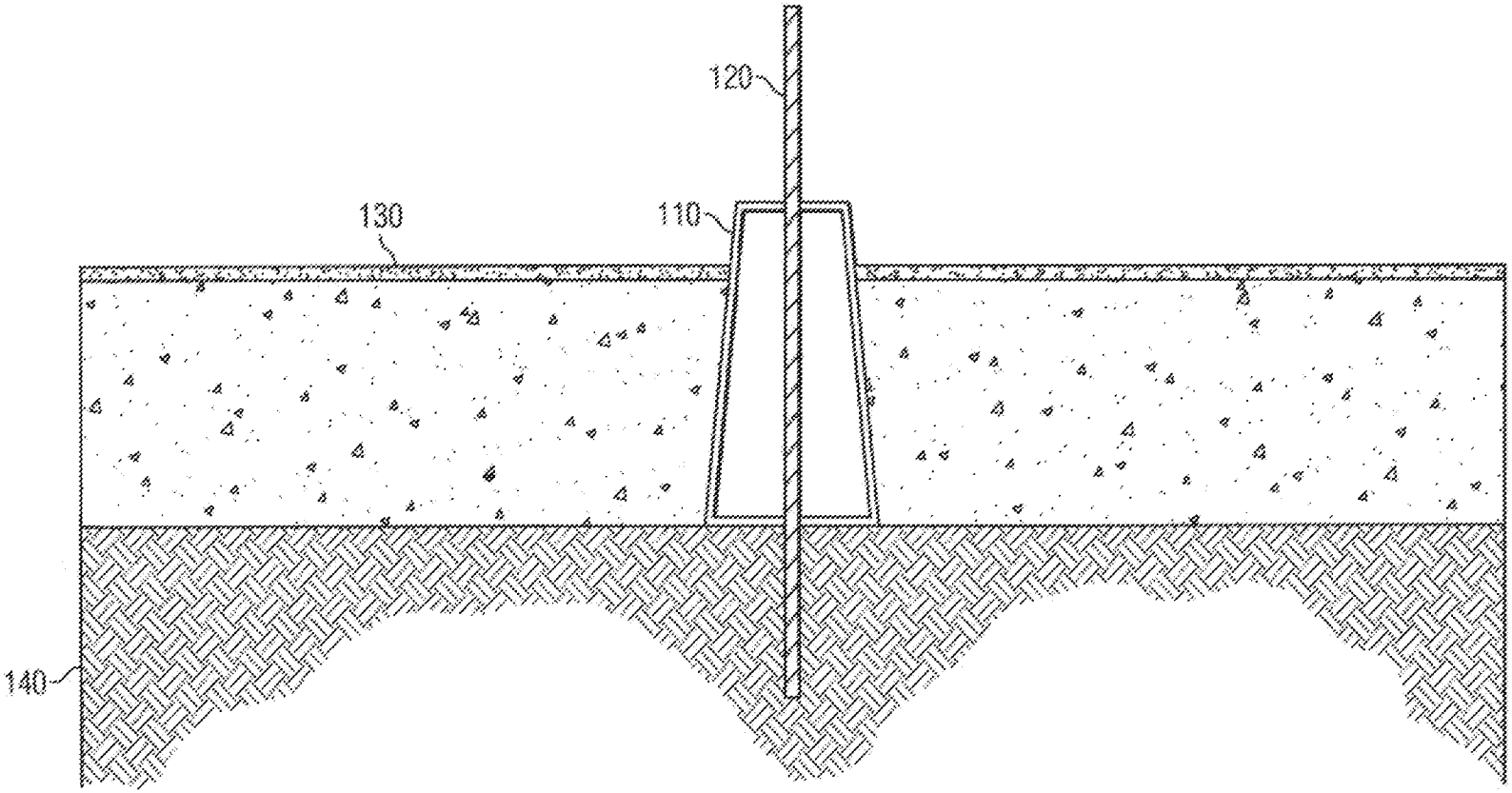
FIG. 1 shows a cross-section of the bottom of a swimming pool.

In one embodiment of the invention, a formation aid is a three-dimensional shape placed in a section of a swimming pool that is being made in order to prevent concrete or other construction material from filling that section. FIGS. 1 and 3 show a formation aid for use in the formation of a weep hole. FIGS. 2, 4, 9 and 10 show a formation aid for use with in the formation of a receptacle. Formation aids for use with a lighting receptacle or a skimmer are also contemplated. In alternative embodiments, formation aids for other types of swimming pool receptacles may be used.

The formation aids are placed in the desired sections for the formation of the receptacles and rebar is placed to support the pool. When Gunite or other construction material is applied, the formation aids prevent the construction material from filling the three-dimensional space. Furthermore, the formation aids prevent debris from entering the void occupied by the formation aid.

2. Characteristics of the Various Formation and Protection Aids

A. Shape

As is clear in FIGS. 1-10, formation and/or protection aids are shaped according to the receptacle to be formed, installed or protected in the swimming pool. In some embodiments, the formation aid is used to form a receptacle that will not be filled later. In this case, the formation aid is designed to have the shape of the desired receptacle. In other embodiments, the formation aid is used to form a receptacle that will be partially or completely filled with construction material or a preformed element. In these cases, some alternative formation aids have special enhancements that allow for better fitting, bonding, or placement of the construction material or a preformed element that will fill the receptacle. For instance, in one alternative, the formation aid may be wider in certain areas to resist slipping or popping. In another alternative, the formation aid may be threaded, like a screw, or have other features that enhance bonding and placement. In another formation, the formation aid may be hourglass shaped, in order to resist force from in and out of a swimming pool. These shapes may be used in any fashion desired to form receptacles in a swimming pool.

Figure 5:
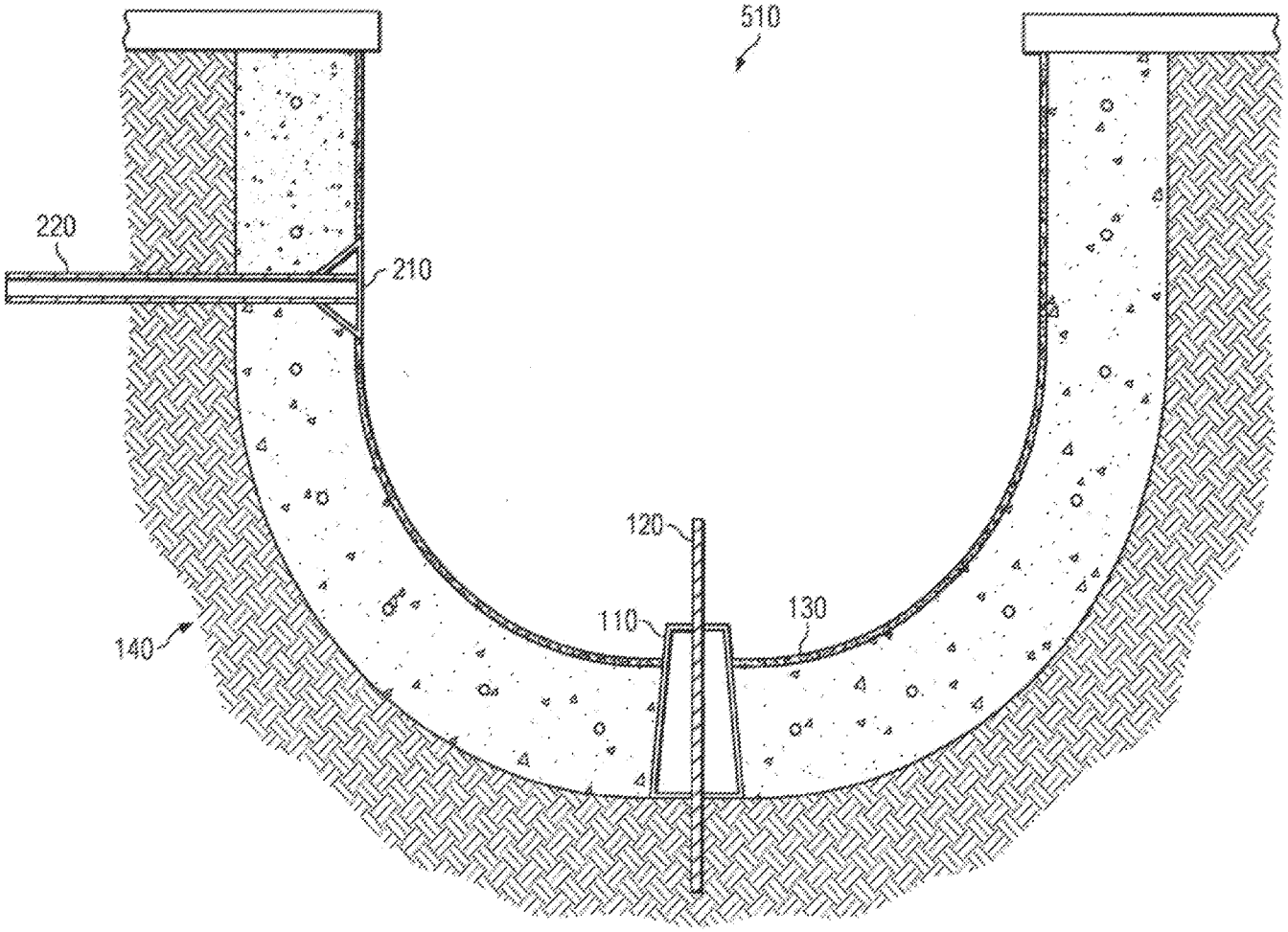
FIG. 5 shows a cross-section of a swimming pool.

Weep hole formation aid 110 shown in FIGS. 1 and 3 has an essentially trapezoidal shape. As can be seen in FIGS. 1 and 3, the narrow end of formation aid 110 is placed interior in relation to the swimming pool 130 and the wide end is placed remotely from the interior of the swimming pool 130. In this way, after the receptacle formed by formation aid 110 is filled with concrete, the resulting plug has enhanced resistance from being pushed into the interior of the swimming pool 130. The perspective view of FIG. 3 depicts the overall shape of the formation aid 110. The narrow end 350 faces towards the interior of the pool and the wide end 360 towards the ground. Formation aid 110 also has a rebar hole 370. Another rebar hole positioned in the bottom of the formation aid 110 is not shown. Rebar hole 370 and the hidden rebar hole are aligned in order to allow a piece of rebar 120 to project through the formation aid 110 as shown in FIG. 1. By virtue of the weep hole formed, water may be released from ground 140 to the interior of pool 130 in order to relieve pressure. Rebar 120 holds the formation aid 110 in place during the formation process. FIG. 5 shows a cross-section of a swimming pool 510. Swimming pool 510 is constructed in the ground 140, and has an interior surface 130. The interior 130 of swimming pool 510 is created by spraying or applying material such as Gunite to the rebar supporting pool 130. Swimming pool 510 shown in FIG. 5 includes weep hole formation aid 110 and receptacle formation aid 210. Weep hole formation aid 110 may be secured in place with rebar 120. Receptacle formation aid 210 is used in conjunction with pipe 220 to form and prepare the area for a swimming pool receptacle, such as a water return head.

Figure 2:
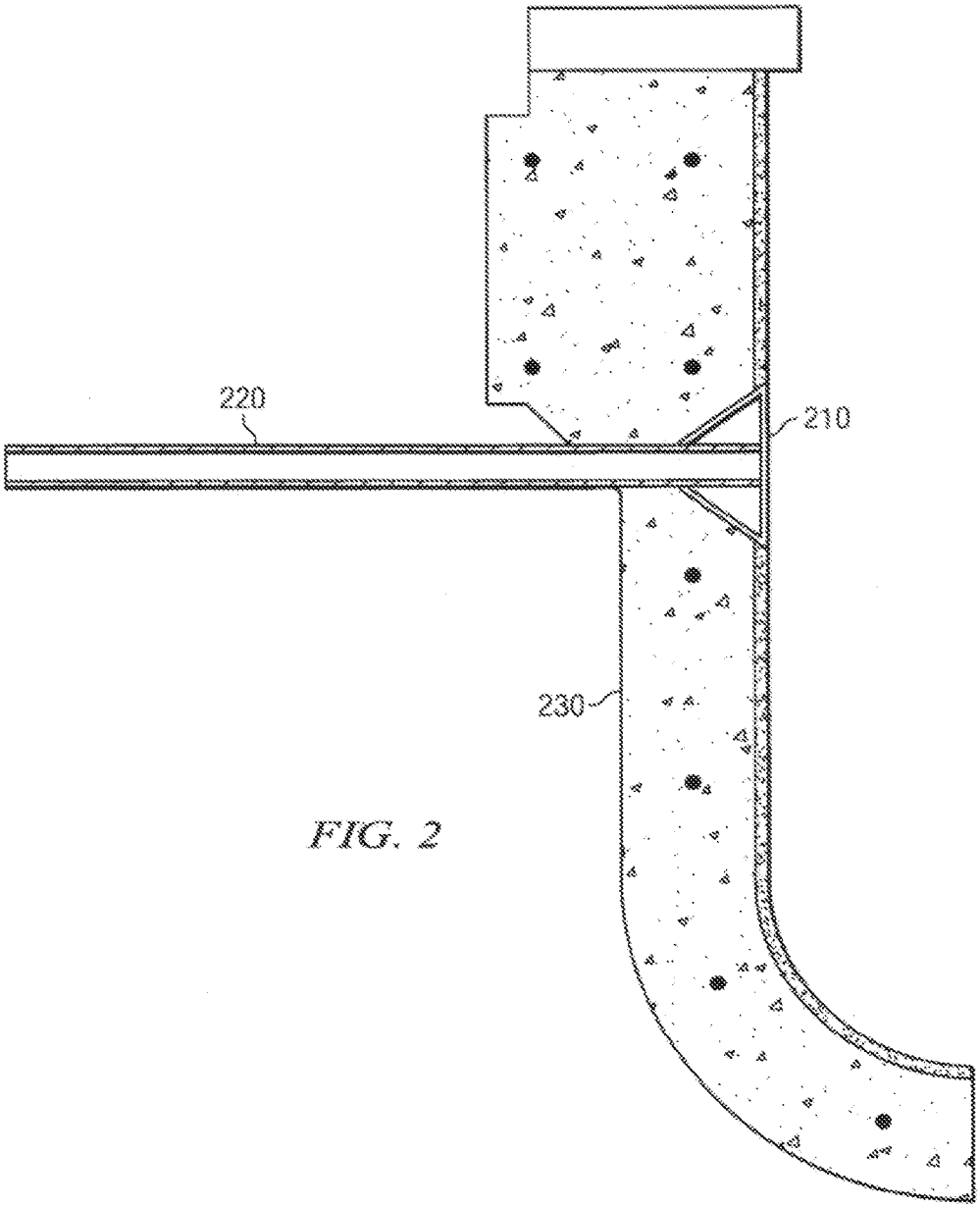
FIG. 2 shows a cross-section of the side of a swimming pool.
Figure 3:
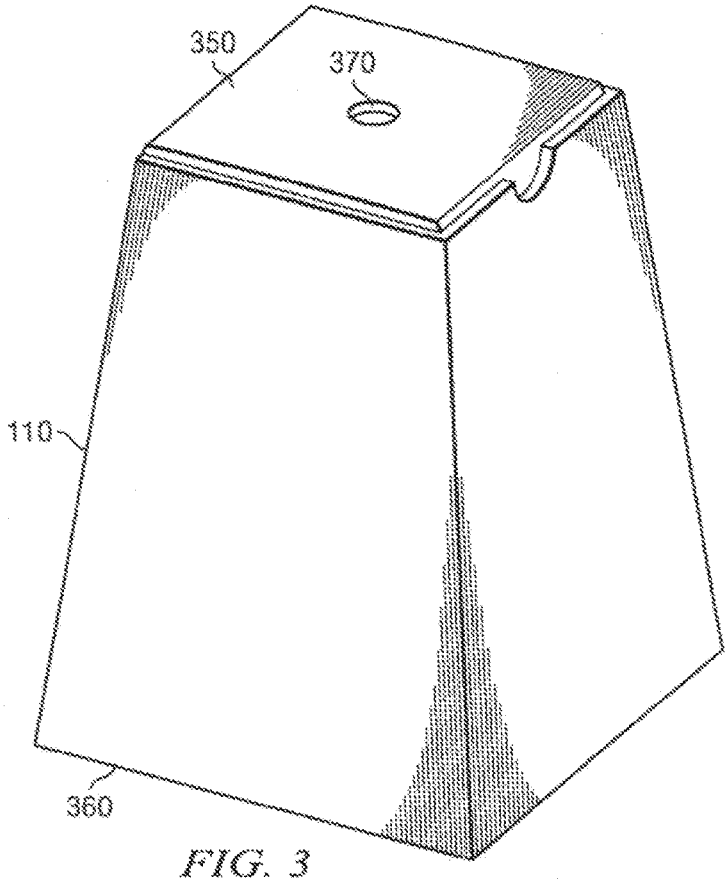
FIG. 3 shows a perspective view of one embodiment of a weep hole formation aid.
Figure 4:
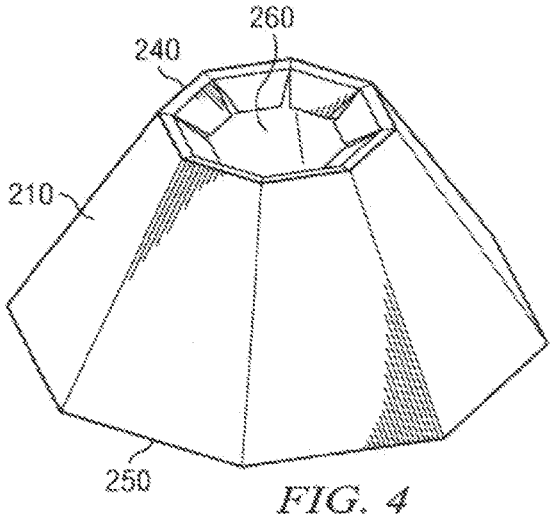
FIG. 4 shows a perspective view of one embodiment of a receptacle formation aid.
Figure 9:
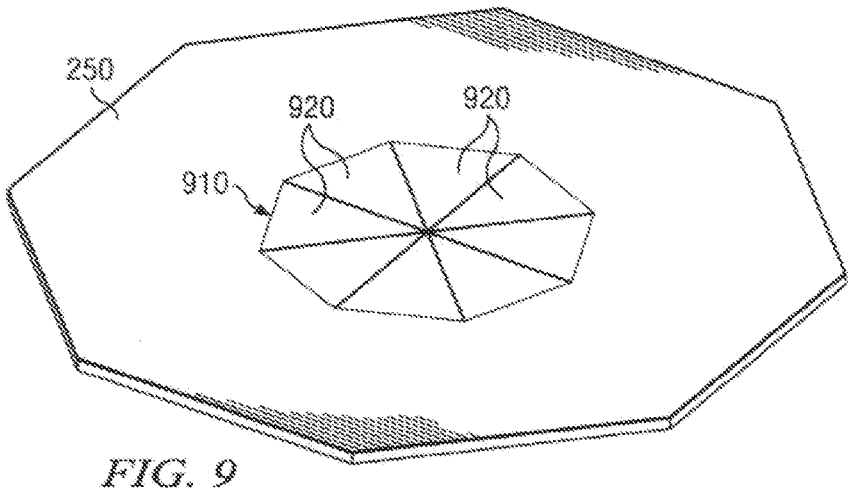
FIG. 9 shows a perspective view of a receptacle formation aid.
Figure 10:
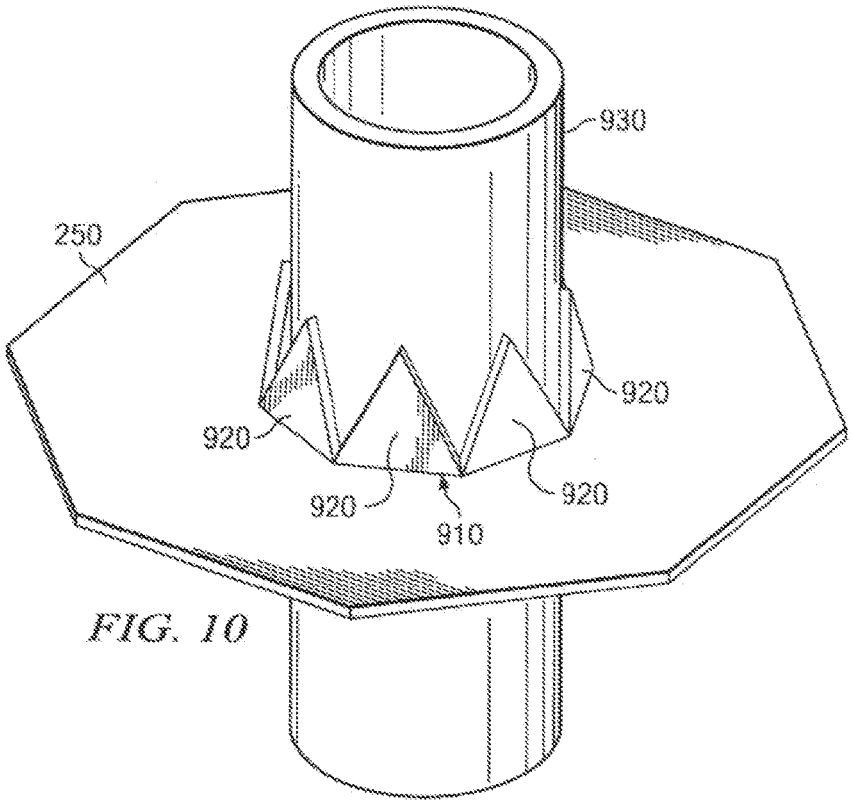
FIG. 10 shows a perspective view of a receptacle formation aid.

As shown in FIGS. 2 and 4, inlet formation aid 210 is essentially conical; however, other shapes may be utilized according to the inlet shape to be utilized. Inlet formation aid 210 has an octagonal horizontal cross-section resulting in angular ridges during the formation of pool 230. After the inlet hole is fitted, the resulting ridges formed by angular ridges of inlet formation aid 210 prevent the plug from rotating, further enhancing the structural integrity. As shown in FIG. 4, inlet formation aid 210 has a narrow end 240 and a wide end 250. Further, hole 260 allows for pipe 220 to extend into inlet formation aid 210. Another hole corresponding to hole 260 is located in the wide end 250 of formation aid 210 allowing pipe 220 to extend through. FIGS. 9 and 10 provide a more detailed view of wide end 250 of formation aid 210. As seen in FIGS. 9 and 10, the wide end 250 of formation aid 210 includes "wings" 920 that are pre-cut to allow passage of a pipe through the hole 910 in the wide end 250 of formation aid 210. These wings expand and extend around the circumference of pipe 930 once formation aid 210 is situated on pipe 930. Adhesive tape, for example, may be applied to these wings to better secure formation aid 210 to pipe 930. In alternatives, a lighting receptacle formation aid is essentially cylindrical for the formation of a space for installation of a lighting receptacle. In this alternative, a formation aid is shaped to adapt to the contours of the lighting receptacle and form a necessary space for adequate access for light installers and for reducing the risk of pockets forming once the area is filled in with construction material at the completion of light installation.

Figure 6:
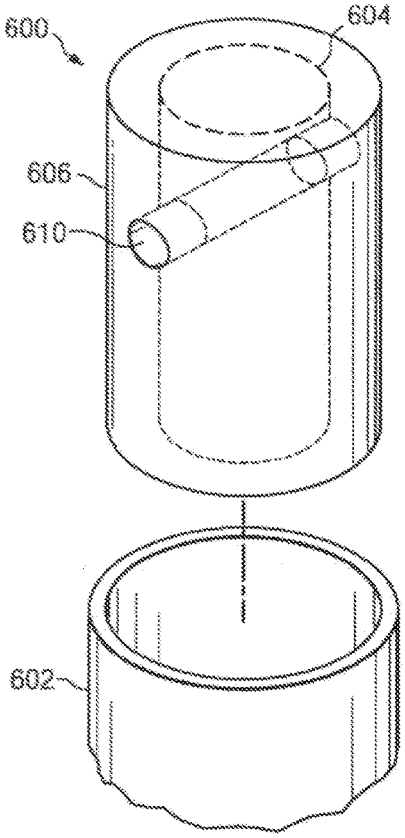
FIGS. 6 and 6A show perspective views of a pipe protection aid.
Figure 6A:
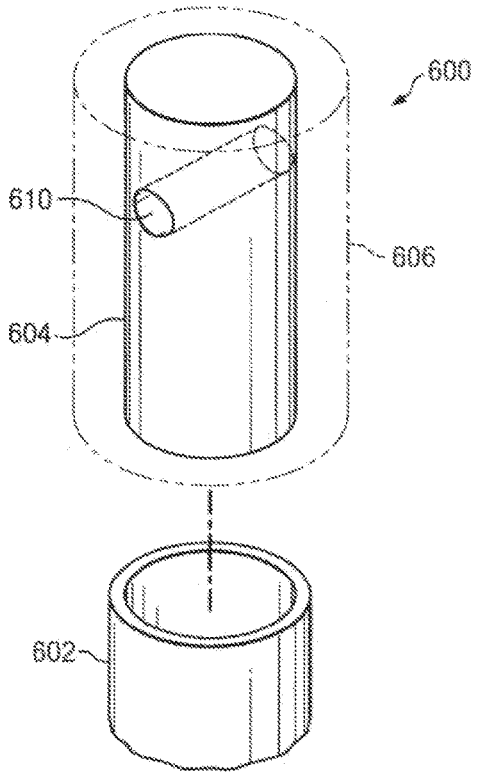

FIGS. 6 and 6A show perspective views of the present pipe protection aid. Pipe protection aid 600 has a substantially cylindrical shape to facilitate insertion into a pipe 602 situated within swimming pool 130. The pipe 602 may be a pipe leading to a water feature receptacle, such as the pipe 220 in FIG. 2, or any other pipe installed as part of a water feature or the swimming pool water circulation and filtration system. The pipe 602 forms part of the water circulation and filtration system of swimming pool 510. Pipe 602 is commonly associated with water return features. During the construction process, pipe 602 may be adapted with a fitting to receive a water return feature that will be put in place upon completion of construction. Before final installation of the water return feature, however, pipe 602 will be left exposed and susceptible to entry of debris, including concrete or marcite, or other materials found at the construction site. This introduction of unwanted materials within pipe 602 will cause severe plumbing problems. Such problems may not be discovered until after the construction process, possibly resulting in expensive and time-consuming post-construction corrective measures and almost certainly resulting in an unhappy customer.

Pipe protection aid 600 is made in substantially a cylindrical shape that when inserted into pipe 602 creates a tight fit that prevents debris from entering the pipe 602. Pipe protection aid 600 also is constructed in separable sections that allow it to fit pipes having different diameters. In one embodiment, pipe protection aid 600 is formed of two cylindrical sections that will accommodate a pipe 602 that has a one and one-half inch or two and one-half inch diameter. In this embodiment, an inner cylindrical section 604 has a first diameter that runs the longitudinal length of pipe protection aid 600 having an overall second diameter. The exact sizes of the first and second diameter may be of any convenient dimension to accommodate pipe sizes most commonly used in a particular application. For example, pipes having a diameter of one and one-half inches and two and one-half inches may be common to a particular project. For such a project, the construction of pipe protection aid 600 provides dual accommodation of pipes of these different diameters. If a pipe 602 in need of protection has a diameter of two and one-half inches, the entire pipe protection aid 600 is inserted, including the inner cylindrical section 604 and an outer portion 606. On the other hand, if a pipe with a smaller diameter of one and one-half inch, the inner section 604 of pipe protection aid 600 is removed and inserted into pipe 600. The remaining outer portion 606 of pipe protection aid may be discarded. Pipe protection aid 600 may be customized to accommodate pipes of virtually any diameter.

In addition to pipe protection aid 600 being able to provide protection of pipes of different sizes, pipe protection aid 600 advantageously includes an orifice 610 for easy removal of pipe protection aid 600 at the completion of the project. In one embodiment, orifice 610 is a cylindrical opening having an axis that is substantially perpendicular to the longitudinal axis of pipe protection aid 600. In this embodiment, the diameter of orifice 610 is large enough to permit removal with the user's finger. By traversing the entire diameter of pipe protection aid 600, orifice 610 makes this removal feature available for both the inner section 604 of pipe protection aid 600 and the entire pipe protection aid 600. By providing this structure for the removal of aid 600, the risk of aid 600 tearing upon removal or being left in pipe 602 and later getting stuffed down into pipe 602, is significantly reduced. The pipe protection aid 600 described herein may be constructed of the materials described below, or in the alternative, may be constructed of a foam material.

Figure 7:
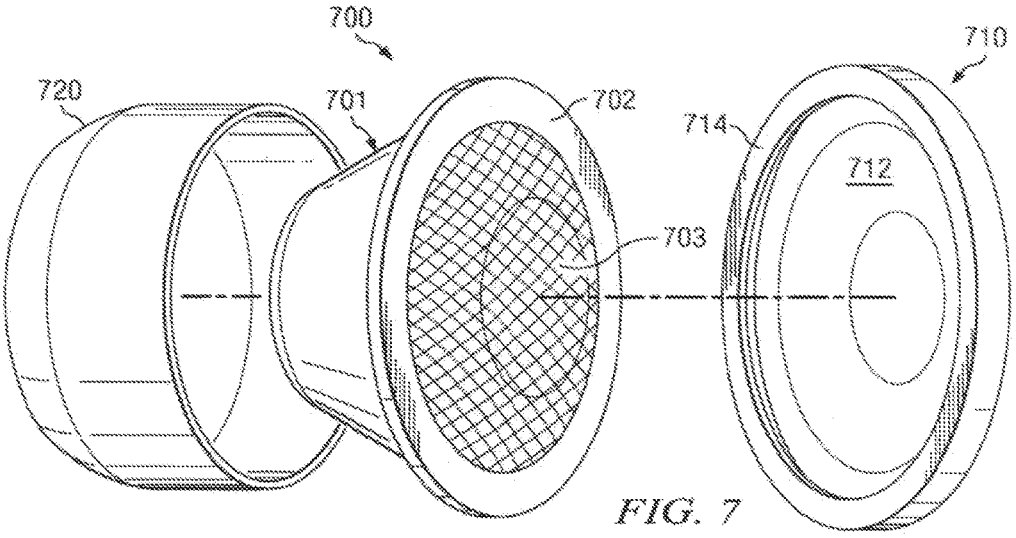
FIG. 7 shows a perspective view of a light fixture protection aid.
Figure 7A:
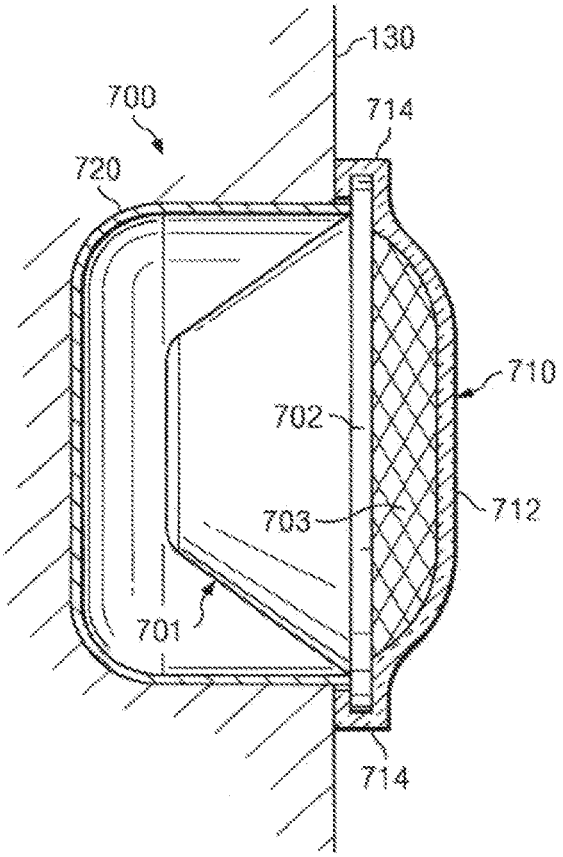
FIG. 7A shows a cross-section view of a light fixture protection aid.

FIG. 7 shows a perspective view of the present light protection aid. Lights are commonly installed in residential and commercial swimming pools. Light fixture 700 of FIG. 7 is susceptible to damage during the construction process. While the formation aids discussed above will facilitate the first stage of light fixture 700 installation, i.e., placement of the socket or light can 720 and associated wiring for ultimate light fixture 700 installation, the light fixture 700 must be installed itself prior to marcite application. Accordingly, light 700 is exposed to application of marcite on the surface of light fixture 700 itself and light fixture 700 itself is exposed to breakage. Light fixture 700 is made of and associated with various parts. A bulb (not shown) is housed within light fixture 700 in the body portion 701. Body portion 701 is coupled to light ring 702 and light cover 703 to enclose light fixture 700. The light protector 710 depicted in FIG. 7 provides the necessary protection. Light protector 710, in one embodiment, is round in shape to conform to the shape of light 700 and to fit snuggly over the light ring 702 and light cover 703, providing the necessary protection. Light fixture 700 is installed within light can 720. Light fixture 700 and light can 720 are installed in the shell structure of swimming pool 130. A cross-sectional FIG. 7A depicts a cross-section of light fixture 700 and installed light protector 710. Light protector 710 is sized to accommodate standard pool light fixtures used in the industry. Light protector 710 includes a front portion 712 that provides coverage protection for the portion of light ring 702 and light cover 703 that is exposed to the inside of the swimming pool during construction. Light protector 710 also includes lip section 714 that extends the circumference of light protector 710. Light protector 710 is made of flexible material such as foam or plastic or may be constructed of cardboard material. Light protector 710 may also be rubber coated to permit stretching light protector 710 over light ring 702 and light cover 703. In a relaxed or un-stretched state, the diameter of the circle formed by lip section 714 is smaller than the diameter of the light ring 702 for which light protector 710 is designed. This sizing of lip section 714 in this manner allows the light protector 710 to be snuggly installed onto light ring 702 and light cover 703. This snug fits eliminates the need to apply adhesives or a fastener to keep light protector 710 in place throughout construction.

While the described embodiment of light protector 710 pertains to a circular light fixture 700, light protector 710 may be molded in any shape to accommodate square, rectangular, oval or any shaped lights.

Figure 8:
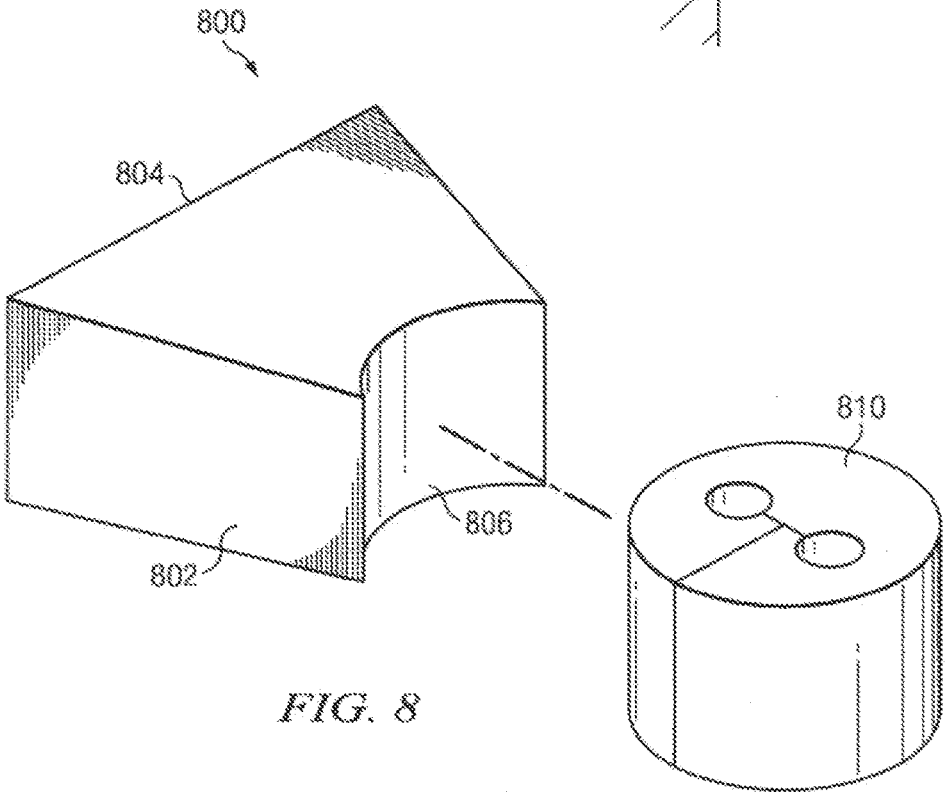
FIG. 8 shows a perspective view of a skimmer throat formation and protect ion aid.

FIG. 8 shows an embodiment of a formation aid for the construction of the skimmer throat of a swimming pool. A pool skimmer, as discussed in U.S. Pat. No. 5,978,978 assigned to the inventor of the present application, facilitates passage of water from the swimming pool, through water circulation and filtration equipment. An automatic surface skimmer receptacle of a type well known in the art may be equipped with a safety or equalizing valve for diverting flow from the skimmer throat or opening to the pool's main drain or equalizing line so as to provide uninterrupted flow to pump connecting line. The skimmer receptacle comprises an upper chamber and basket chamber.

The present formation and protection aid facilitates the construction process in the area surrounding the skimmer throat or opening. Specifically, FIG. 8 shows a skimmer opening formation/protection aid 800 that is advantageously shaped in a substantially trapezoidal configuration. The narrow or tapered end 802 of aid 800 is inserted first into the skimmer opening. The broad end 804 of aid 800 is situated in close proximity to the interior of pool wall 130. The shape of skimmer opening formation/protection aid 800 is such that it fits tightly into the swimming pool skimmer openings. During the construction process, this fit prevents construction material from entering the skimmer opening and associated pipes and receptacles within the skimmer. The preventative and formation advantages of aid 800 are increased by the substantially concave configuration 806 of the narrow or tapered end 802. The substantially concave configuration 806 allows aid 800, when inserted, to form a tight-fitting interface with cylindrical plug devices, such as those disclosed in U.S. Pat. No. 5,978,978, that are inserted within the main body portion of a skimmer to prevent introduction of debris or building materials to the innards of the skimmer and associated plumbing. The union of concave end 806 with the cylindrical plug provides enhanced protection within the entire skimmer location. The skimmer formation aid 800 described herein may be constructed of the materials described below, or in the alternative, may be constructed of a foam material.

B. Material

One feature of the formation aids and protection aids described herein is that they are easily removable after the construction material is applied, while at the same time sufficiently rigid to provide a precise formation structure, and durable enough to prevent the penetration of and/or catch debris that might fall in the receptacle formed during construction. Numerous materials are acceptable for this purpose including, plastics, fiber glass, wood, and cardboard. In addition, the material of which the formation and/or protection aids are formed may be rubber coated. In some alternatives, a coating is applied to prevent the construction material from bonding to the formation aid. An example of a coating is wax. In one embodiment, cardboard coated with wax is used to form the formation aid. Cardboard is easily crushed and removed after formation, however, is sufficiently rigid for formation. In one alternative, a cardboard formation aid has tabs and folds that may be release and unfolded for easier removal. Thin plastic, fiberglass, or wood may be coated and used in a similar fashion. Cardboard allows for the easy passage of water through the weep hole due to its porousness. In one alternative, the material used may be perforated with small holes allowing for the passage of water but not debris.

C. Other Enhancements

In one embodiment the formation aid may have a hole for catching debris. Such a hole makes cleanup after formation easier. In another embodiment as shown in FIG. 1, weep hole formation aid 110 has a hole 370 in the narrow end of the formation aid that faces the interior of the pool. The hole 370 also allows for water to easily pass into the pool during formation. Hole 370 also supports the insertion of rebar 120 as explained above.

In one embodiment, the formation aid includes an integrated attachment mechanism, for attaching the formation aid to nearby rebar. An example of an integrated attachment mechanism is a plurality of thin wires that have been taped, glued or otherwise attached the formation aid. These wires may be tied or wrapped around nearby rebar to hold the formation aid in place during the application of construction material. After the construction material has set, these aids are detachable from the formation aid and are left embedded in the construction material.

D. System and Method

One embodiment of a system for forming a swimming pool includes the above discussed formation aid. The system includes a plurality of rebar supports that form the basic shape of the pool. The system includes a water circulation system that is properly placed according to the positioning of the pool. The system includes at least one formation aid, such as a weep hole formation aid (FIG. 1), positioned according to the structure of the pool and the water circulation system. After the rebar and formation aids are positioned, along with the appropriate portions of the water circulation system, construction material such as Gunite is applied to form the solid structure of the pool. Some embodiments may not include the usage of rebar.

An embodiment of a method for forming a swimming pool includes the above discussed formation aid. The formation aid is placed as is the rebar. Then the construction material is applied. After formation, the formation aid is removed without allowing debris into the resulting receptacle. The resulting receptacle is then filled or left empty depending on the type of receptacle formed. In one embodiment, the receptacle is a weep hole. The formation aid is essentially conical in order to form a weep hole that has a narrower portion near the interior of the pool and a wider portion remote from the interior. After the weep hole is filled, due to the angular nature of the plug, it resists popping.

Although the present invention has been described with reference to specific embodiments, this description is not meant to be construed in a limited sense. Various modifications of the disclosed embodiments, as well as alternative embodiments of the present invention will become apparent to persons skilled in the art upon the reference to the description of the present invention.

I claim:

1. A system for preventing entry of debris into a drainage system during construction, comprising:

(a) a first flexible insert having a length, a width and a height substantially equal to a length, a width and a height of a channel beneath which is a first drain opening; and (b) a second flexible insert having a cylindrical shape and removably integrated into the first flexible insert, the second flexible insert having a diameter substantially equal to a diameter of a pressure relief pipe; and (c) a third flexible insert having a cylindrical shape and removably and longitudinally integrated into the second flexible insert, the third flexible and cylindrical insert having a diameter smaller than a diameter of the second flexible insert, wherein the second flexible insert has a longitudinal axis substantially equal to the height of the channel.

2. The system of claim 1, wherein the first flexible insert is constructed of foam.

3. The system of claim 1, wherein the second flexible insert is constructed of foam.

4. The system of claim 1, further comprising a section of the first flexible insert having a width greater than a diameter of the first drain opening.

5. The system of claim 1, wherein the width of the first flexible insert is greater than twice a diameter of the first drain opening.

6. The system of claim 1, further comprising an orifice within the second flexible insert, the orifice having a longitudinal axis substantially perpendicular to a longitudinal axis of the second flexible insert.

* * * * *